US005941040A

United States Patent [19]

McAnallen et al.

[11] Patent Number: 5,941,040

[45] Date of Patent: Aug. 24, 1999

[54] STERILE ROOM STRUCTURES

[75] Inventors: Kevin McAnallen; Sean McAnallen, both of Dundalk; James Dully; Conor Murray, both of Dublin; Ciaran Corrigan, Dundalk, all of Ireland

[73] Assignee: Ardamc Technology Limited, Dublin, Ireland

[21] Appl. No.: 08/873,699

[22] Filed: Jun. 12, 1997

[30] Foreign Application Priority Data

Jun. 12, 1996 [IE] Ireland ..... S960435
Jun. 12, 1996 [IE] Ireland ..... 960437

[51] Int. Cl.[6] ..... E04B 2/32

[52] U.S. Cl. ..... 52/586.1; 52/287.1; 52/288.1; 52/459; 52/461; 52/464; 52/483.1; 52/506.06; 52/506.08; 52/506.09

[58] Field of Search ..... 52/588.1, 79.1, 52/483.1, 220.6, 287.1, 459, 461, 288.1, 464, 506.06, 506.08, 506.09, 586.1; 454/187, 220, 232

[56] References Cited

U.S. PATENT DOCUMENTS 4,409,889 10/1983 Burleson ..... 52/79.1 X
4,667,579 5/1987 Daw ..... 52/79.1 X
5,256,105 10/1993 Austin ..... 52/79.1 X
5,297,370 3/1994 Greenstreet et al. .

FOREIGN PATENT DOCUMENTS 2413328 10/1975 Germany .
569160 11/1975 Switzerland .
2264165 8/1993 United Kingdom .
WO9301369 1/1993 WIPO .
WO93/25775 12/1993 WIPO .

*Primary Examiner*—Christopher Kent
*Attorney, Agent, or Firm*—Jacobson, Price, Holman & Stern, PLLC

[57] ABSTRACT

A sterile room structure (1) has an air wall (3) suspended from a purlin (5). The air wall (3) and an outer wall (2) and fixed walls (8) comprise panels (10) of high density phenolic resin construction. The panels are machined along the side edges to provide recesses for interengagement. Support of the panels is by way of bridging members which connect to the rebates (11) at joints between them. Joints are completed by seals of adhesive bio-sealant material to achieve desired adhesion and mechanical flexibility. The combination of phenolic resin panels, aluminium supports and coving members, and seals provides a sealed structure which may be easily modified later.

10 Claims, 9 Drawing Sheets

STERILE ROOM STRUCTURES

FIELD OF THE INVENTION

The invention relates to sterile room structures for pharmaceutical, biotechnology, or healthcare industries. A particularly important example of such an environment is the filling area for a pharmaceutical production process.

PRIOR ART DISCUSSION

There are several requirements of a sterile room structure for use in such environments. These could be grouped into three main requirements as follows:

(a) the ability to withstand application of aggressive cleaning chemicals and to provide a wear resistant surface, (b) provision of a biological seal without indentations or crevices, and (c) an anti-static property whereby there is little particle attraction to the wall surfaces.

A traditional approach to provision of a clean room structure has been to apply a "rubberised" paint to conventional masonry walls. Another approach is to use steel partition structures to which coatings are applied. For both of these approaches, there is generally a reasonably satisfactory performance for requirement (c) above. However, both mechanical and chemical wear tend to over time break the seal and chemicals can enter behind the coating where the seal is broken to cause further damage. The chemicals also cause discoloration over time.

It is also known to provide a structure which comprises panels assembled on a structural frame. Such arrangements are described, for example, in PCT Patent Specification No. WO 93/01369, and U.S. Pat. No. 5,256,105 and U.S. Pat. No. 5,297,370. In U.S. Pat. No. 5,256,105, use of composite panels having a particle board core with high pressure laminates (30 and 32) bonded to the surfaces of the core is described. In U.S. Pat. No. 5,297,370, panels are described which are of high density fire rated particle construction, covered with a protective sanitary covering. The covering may comprise a plastics laminate such as Formica. Alternatively, the covering may be a PVC shatterproof covering.

While these sterile room structures are apparently relatively simple to construct, it appears that some problems could arise over time in satisfying the above three requirements, particularly because of cyclic thermal expansion and contraction. Some discontinuity of the seals could arise and integrity of the seals may not be maintained over a prolonged period of time. For example, in U.S. Pat. No. 5,256,105, a continuous seal of epoxy paint is applied over the interior surfaces of all parts. This is an expensive operation and renders the system difficult to modify later as the seal must be broken if a panel is removed. Further, while U.S. Pat. No. 5,256,105 describes a ducting arrangement for outlet of air, there is a need for an improved air outlet arrangement with less particle accumulation. In WO 93/01369, it is not specified what the material of the panels is. However, regarding the overall construction it is noted that the surface exposed to the clean room is not flush and therefore crevices may develop.

The invention is directed towards providing a clean room structure which provides sealed walls to satisfy the above requirements, while also providing ease of on-site installation with flexibility and ease of modification.

SUMMARY OF THE INVENTION

According to the invention, there is provided a sterile room structure comprising:

a wall comprising a plurality of panels having elongate rebates machined in side edges;

panel fasteners comprising bridging members extending between panels at adjoining side edges, each bridging member having tongues inserted in opposed panel rebates and being supported by a soleplate pressing against external non-exposed surfaces of the panels;

coving members presenting external coving surfaces and comprising sockets engaging adjoining wall panels; and seals extending along joints between adjoining panels, between panels and coving members, and between panels and floor covering layers, the seals being of adhesive bio-sealant silicone material, and being shaped to provide a continuous flush exposed surface where panels adjoin.

In one embodiment, the panels are of homogenous thermosetting plastics material, and preferably polymerised high density phenolic resin material.

Preferably, the panels are of the type produced by compressing base layers of substrates treated with phenol formaldehyde resin and outer layers of substrates treated with melamine formaldehyde resin, and pressing the layers at a pressure in excess of 5 $MN/m^2$ at a temperature in excess of 220° C. whereby the resins fuse to form a composite panel.

In one embodiment, the sockets of the coving members and the rebates of the panels are configured to provide a clearance for mutual expansion and contraction.

Preferably, the coving members are coated on exposed surfaces by a baked enamel polyester coating.

The adhesive seals preferably have a cross-sectional area of at least 12 $mm^2$.

In one embodiment, the structure further comprises an air wall supported by a plurality of lateral supports connected at joints between panels.

Preferably, the lateral supports have an aerofoil configuration.

In another embodiment, the lateral supports are connected to the air wall by panel fasteners.

Ideally, the soleplates of the panel fasteners each have an inner recess housing a resilient gasket pressing against the panels.

In one embodiment, the air wall is also suspended at an upper side edge by a ceiling coving member.

DETAILED DESCRIPTION OF THE INVENTION

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF THE PREFERRED EMBODIMENT

Figure 1:
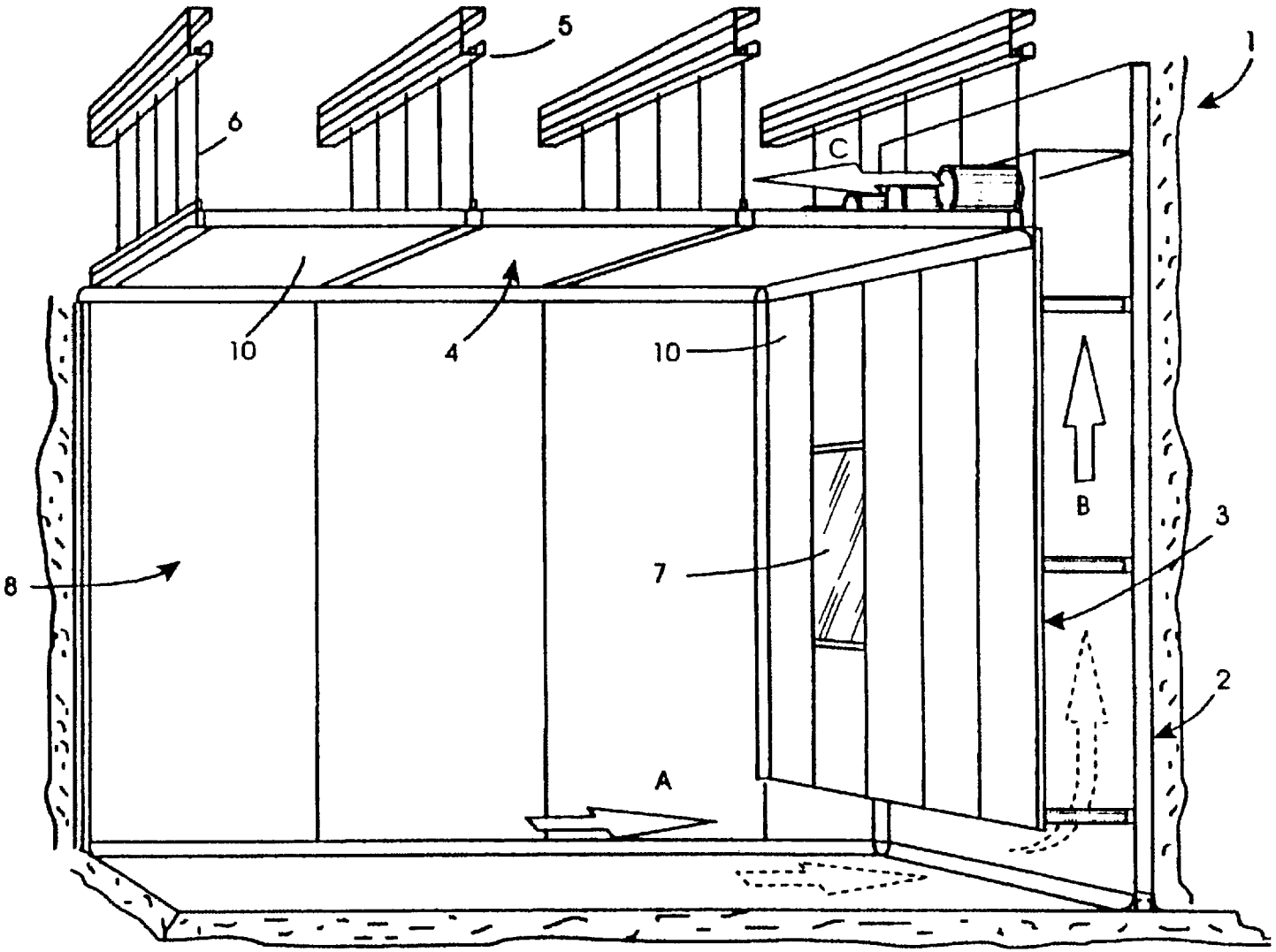
FIG. 1 is a perspective view of portion of a sterile room structure of the invention.

Referring to the drawings, and initially to FIG. 1, there is shown a sterile room structure of the invention, indicated generally by the reference numeral 1. The structure 1 comprises on one side an outer wall 2 formed by cladding on masonry. An air wall 3 is mounted inwardly of the outer wall 2 and is suspended from purlins 5 by stays 6. The air wall 3 has a flush-mounted window 7. The structure 1 also comprises walls 8 formed as cladding on a masonry base wall.

Only one side of the room has an air wall 3. The purpose of the air wall 3 is to remove sterile air which is pumped into the room through ducts, not shown, in the ceiling. The air passes underneath the air wall 3 as indicated by the arrow A and moves upwardly behind the air wall 3 in the gap between it and the outer wall 2 as shown by the arrows B. As indicated by the arrow C, the air exits via the space above the suspended ceiling 4.

The walls comprise homogenous panels 10 of a thermosetting resin material, in this embodiment polymerised phenolic resin. The panels are therefore not laminated and are particularly suitable for machining to a fine tolerance for interconnection as described below. Further, the panels are excellent at withstanding the high temperatures and aggressive cleaning chemicals applied in use of a sterile room.

The production method for the panels 10 is to provide a base layer of brown cellulose paper treated with phenol formaldehyde resin. A cellulose paper bearing the desired colour or printed pattern and being impregnated with melamine formaldehyde resin is mounted on the base layer. Finally, there is an over-layer of alpha cellulose paper treated with melamine formaldehyde resin. Under a pressure of approximately 5 $MN/m^2$ and an elevated temperature of greater than or equal to 220° C. in a large hydraulic press, the layers of impregnated paper are compressed and consolidated. The thermosetting resins fuse and flow, and finally cure in an irreversible chemical reaction which unite the various layers into an homogenous, composite panel. The thickness depends on the number of base layers used.

The resultant panel has excellent wear and abrasion-resistant properties, making it suitable for cleaning, sanitising and fumigating. Other properties include resistance to surface spread of flame, resistance to chemical attack, resistance to damage caused by ultraviolet rays, to humidity, to water and to extremes of temperature. Another very important aspect of the panels 10 is that during construction of the structure 1, they are particularly suitable for machining to very fine tolerances to provide good quality seals. In more detail, the following are some of the important characteristics:

| Characteristic | Standard | Units | Value |
|---|---|---|---|
| Resistance to Surface wear | ISO 4586/11 | Taber Revs | A: ≧850<br>B: ≧350 |
| Resistance to Scratching | ISO 4586/11 | | ≧2 |
| Resistance to Cracking | ISO 4586/11 | $N/mm^2$ | ≦Grade 4 |

-continued

| Characteristic | Standard | Units | Value |
|---|---|---|---|
| Impact Resistance (Falling Ball) | NTF 54359 | $N/mm^2$ | 1.20 × 6mm<br>0 ≦5 print |
| Linear thermal expansion coefficient | ASTM-D-696 | $N/mm^2$<br>HRE | L-≦$1.5 \times 10^{-5}$<br>T-≦$2.5 \times 10^{-5}$ |
| Surface Spread of Flame | BS 476 Pt7 | | Class 1 |
| Surface resistivity | BS 2782 | % | $1.5 \times 10^9$<br>i.e. the panels are antistatic |

Figure 2:
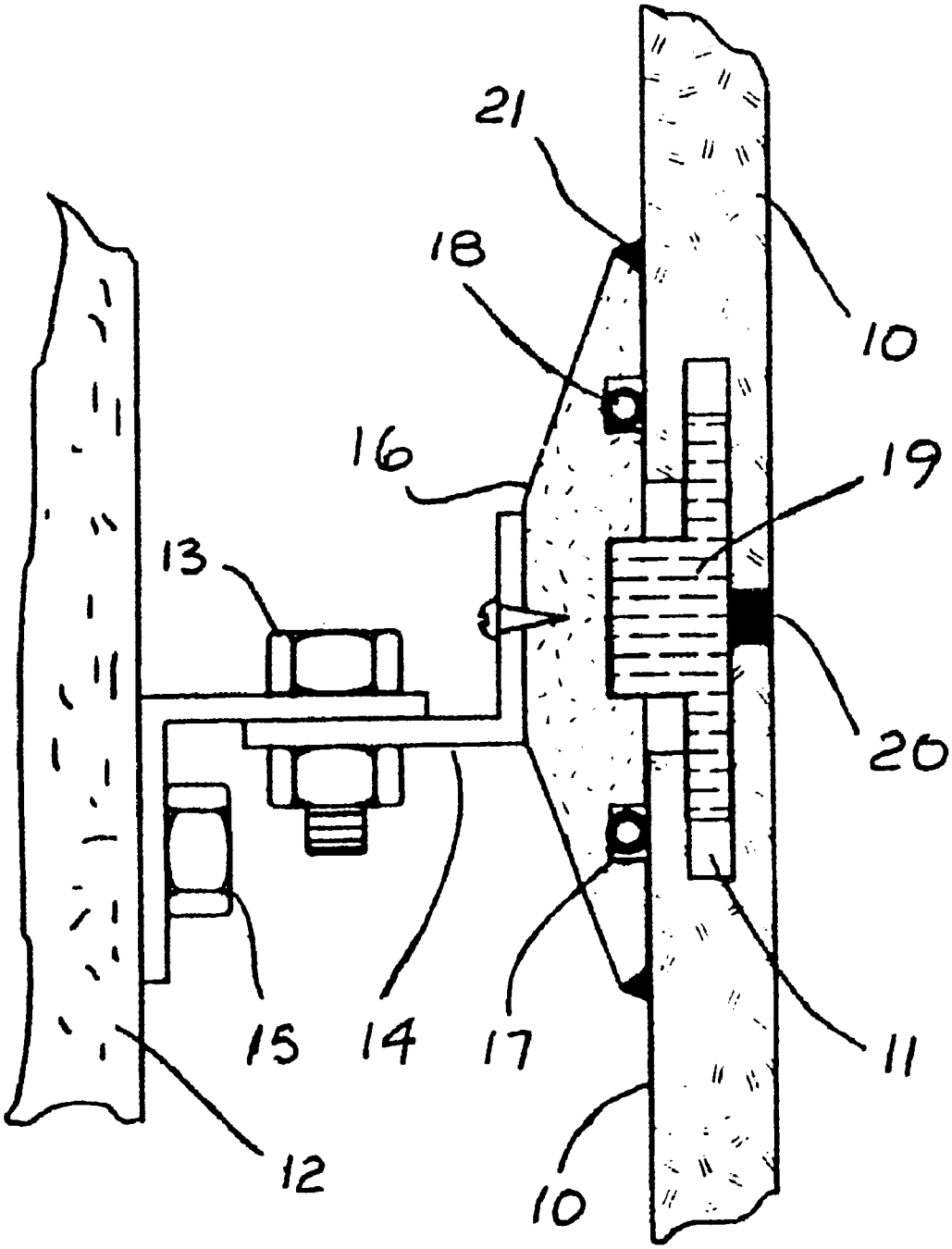
FIG. 2 is a plan view showing the manner in which cladding is connected to a masonry wall.

Referring now to FIG. 2, the manner in which the panels 10 are interconnected is shown in more detail. Rebates 11 are machined in side edges of the panels 10. A Z-shaped bracket 14 is bolted to a masonry wall 12 by a bolt 15 and at the other end is connected by a screw fastener to an aluminium soleplate 16 forming part of a panel fastener. The bracket 14 comprises two interleaved L-shaped brackets having elongate slots through which a fastener 13 extends. This allows pre-setting of the depth of the bracket 14 to allow for inconsistency in the masonry wall 12. The soleplate 16 has a pair of elongate recesses 17 within which sealing gaskets or beads 18 are mounted. The sealing beads extend proud of the inner surface of the soleplate 16 before installation so that they press against the panels 10 after installation. Finally, there is an aluminium bridging member 19 which is secured to the soleplate 16 by screws (not shown) and engages within the rebates 11 of the adjoining panels 10. The joint is completed by a seal 20 in the gap between the panels 10 and seals 21 of the same material along the edge of the soleplate 16. The seal 20 provides continuity of a flush surface exposed to the clean room, the fastening arrangement being hidden behind.

The bridging member 19, the soleplate 16 and the beads 18 all extend vertically for the height of the wall, the brackets 14 being provided at regular intervals.

The fact that the side edges of the panels 10 have rebates allows interconnection by the bridging member 19 to achieve a flush exposed surface in a simple manner. The rebates 11 allow for mutual expansion and contraction of the aluminium parts 16 and 19 and the resin panels 10. The gap between the panels 10 at the exposed surfaces for the seal 20 is set to allow a seal having a cross-sectional area of at least 12 $mm^2$ and most preferably at least 20 $mm^2$. This is important both to provide excellent adhesion of the sealant to the contact surfaces, and to provide sufficient bulk of sealant to accommodate the expansion and contraction which arises during use.

The panels 10, as described above, are of phenolic resin material. The parts 16 and 19 are of extruded aluminium material. As they do not have exposed surfaces they are not coated, however, aluminium parts such as coving members which have external surfaces are coated to provide the required sterile room qualities. The sealant is an RTV adhesive bio-sealant of RTV silicone rubber marketed under one of the names GE Silicone RTV 106, 116, or 133™.

The diagram of FIG. 2 shows a good example of the phenolic resin/aluminium/silicone sealant material system of the structure. It has been found that these materials integrate together exceptionally well to provide an excellent seal, without the need for an auxiliary coating applied externally over all components. This is achieved by choice of the materials, the manner in which the sealant is applied, and the manner in which the panels are machined and joined together as described above.

Figure 3:
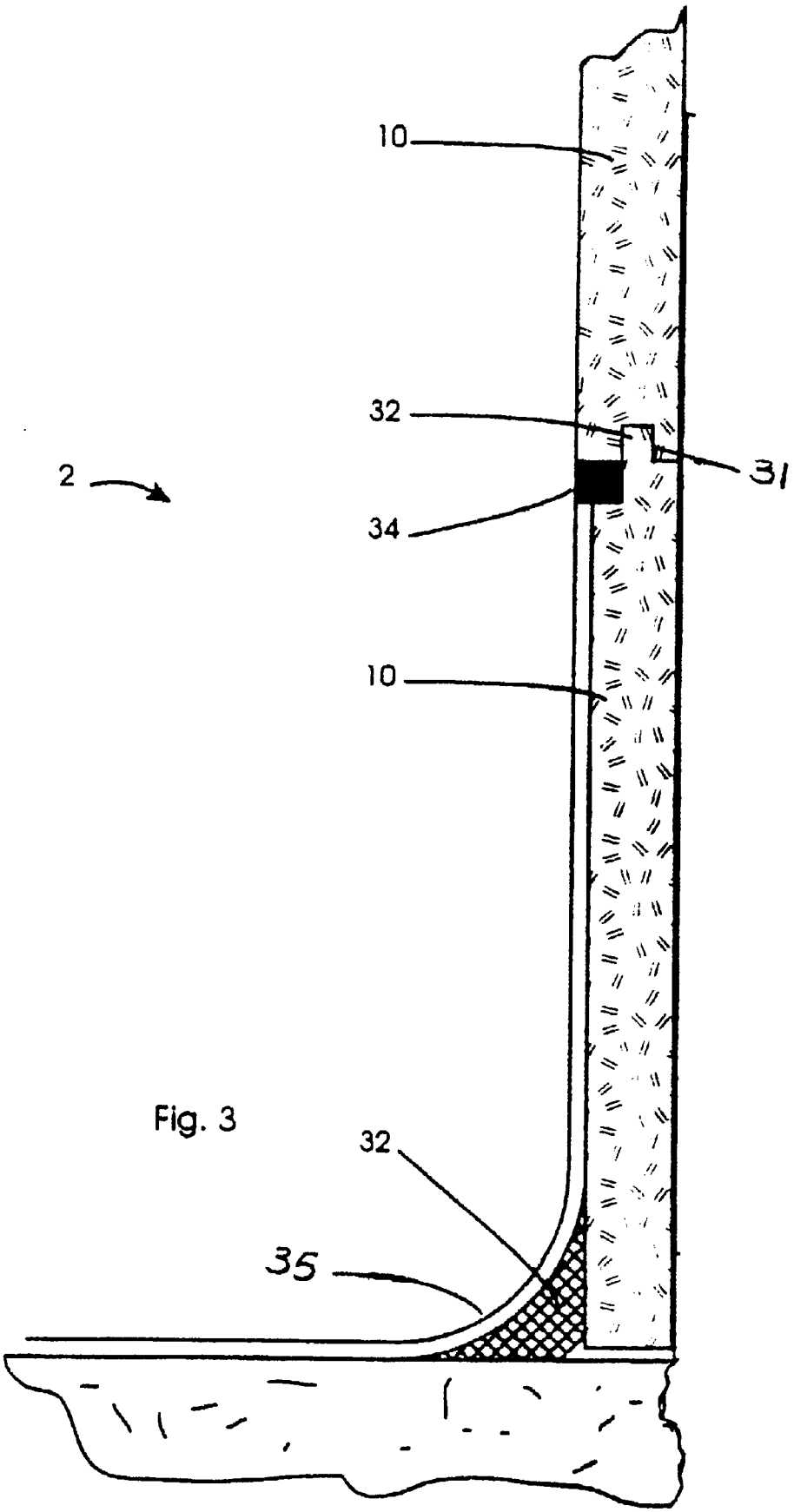
FIG. 3 is a cross-sectional side view showing connection of cladding to a floor.

Referring to FIG. 3, there is shown the base of the outer wall 2 in which a pair of panels 10 are interconnected by a tongue 32 on the lower panel and a rebate 31 on the upper panel. A PVC floor coving member 35 is mounted along the base of the wall 2 and this is surrounded by a Mipolam™ layer 33. The joint between the layer 33 and the upper panel 10 is sealed by an RTV silicone seal 34.

Figure 4:
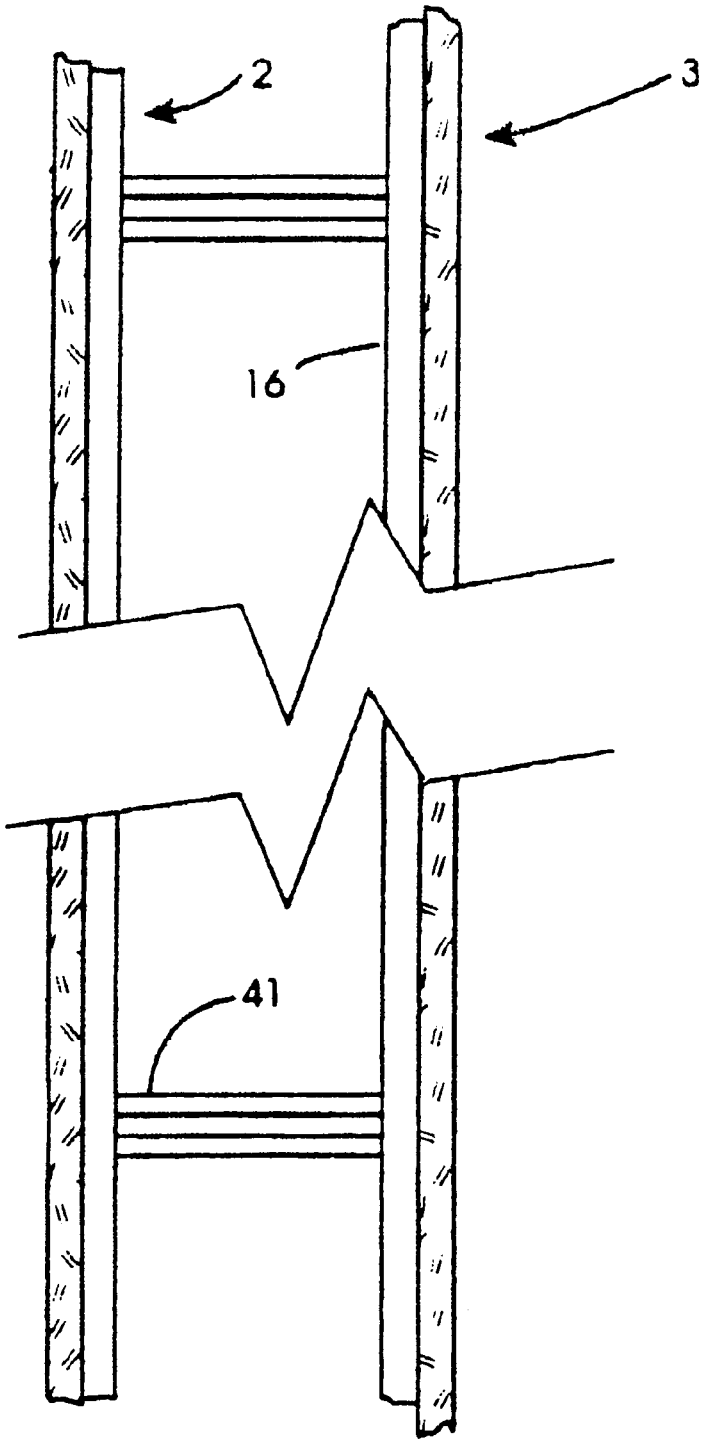
FIG. 4 is a diagrammatic cross-sectional view showing construction of an air wall.
Figure 6:
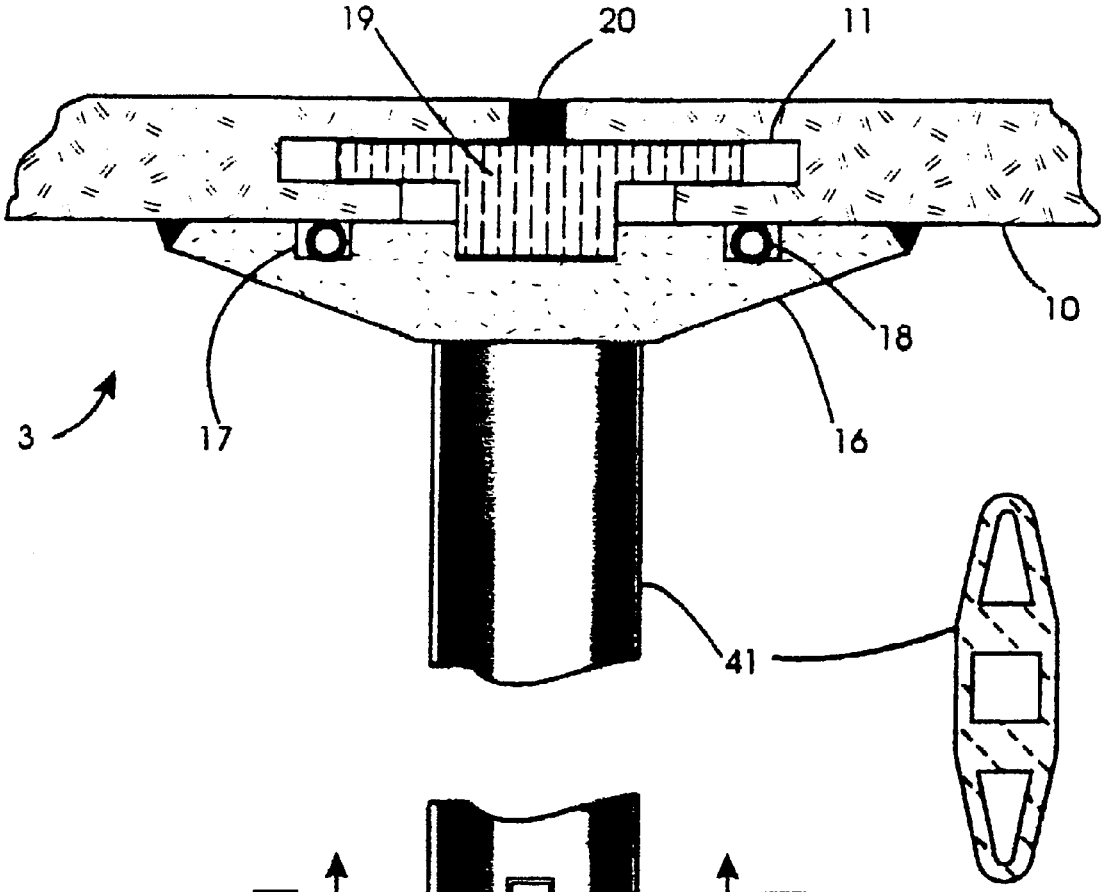
FIG. 6 is a cross-sectional view in the direction of the arrows VI—VI of FIG. 5.
Figure 5:
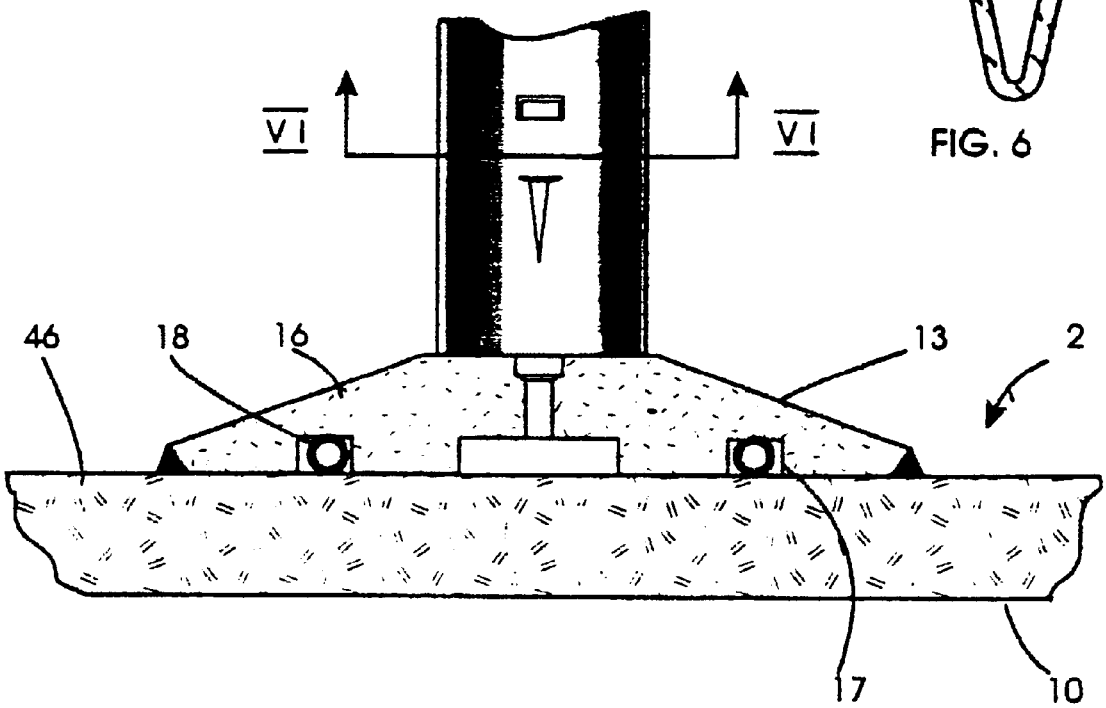
FIG. 5 is a diagrammatic plan view showing part of an air wall.

Referring to FIGS. 4, 5, and 6, the air wall 3 is shown in more detail. The air wall 3 is supported by a vertically-extending series of horizontal lateral supports 41 in an aerofoil configuration, shown most clearly in FIG. 6. The lateral supports 41 are connected to the panels 10 of the walls 2 and 3 by connectors as shown in FIG. 2 and like parts are indicated by the same reference numerals. The supports 41 are fastened by panel fasteners to the relevant soleplate 16.

It will be appreciated that the supports 41 provide strong support for the air wall 3, while also minimising particle accumulation. The manner in which they are connected to the panels 10 also provides clean, open surfaces while also providing high mechanical strength. An important aspect of the joints shown in FIGS. 2, 4, and 5 is that the surface presented to the room is continuous and there are no exposed fasteners.

The soleplates 16 and the lateral supports 41 have exposed surfaces and are therefore coated to provide the desired surface qualities. The coating is of polyester material applied as a spray and having a specific gravity of in the range 1.2 to 1.9. An important aspect is that the coating is baked at a temperature of 190° C. for 15 mins. to provide a durable, enamel finish. The thickness is 60 microns. It has been found that this coating in combination with the sealant and phenolic resin panels provides an excellent hermetic seal to the sterile room.

Figure 7:
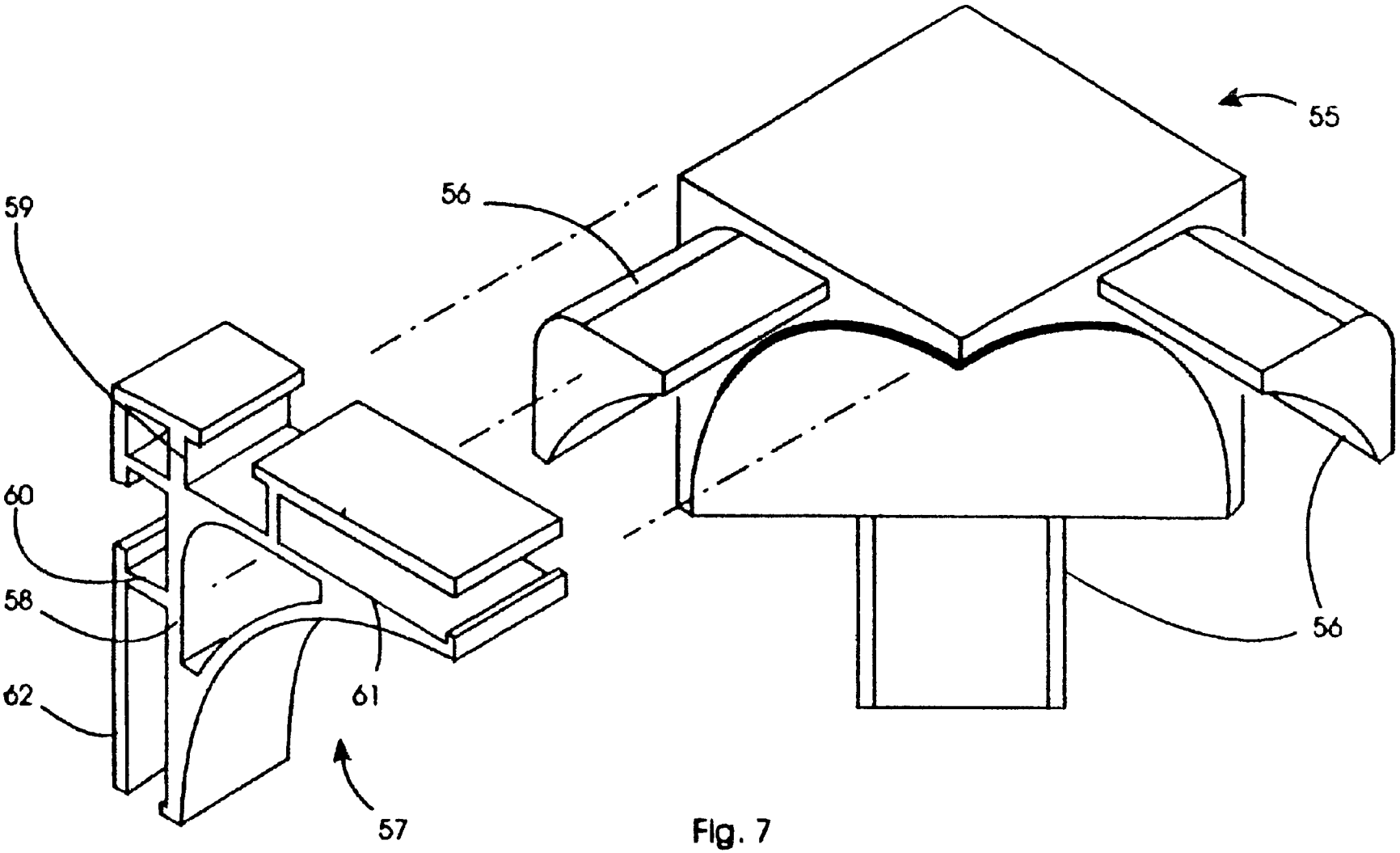
FIG. 7 is a perspective view of a corner coving member.
Figure 8:
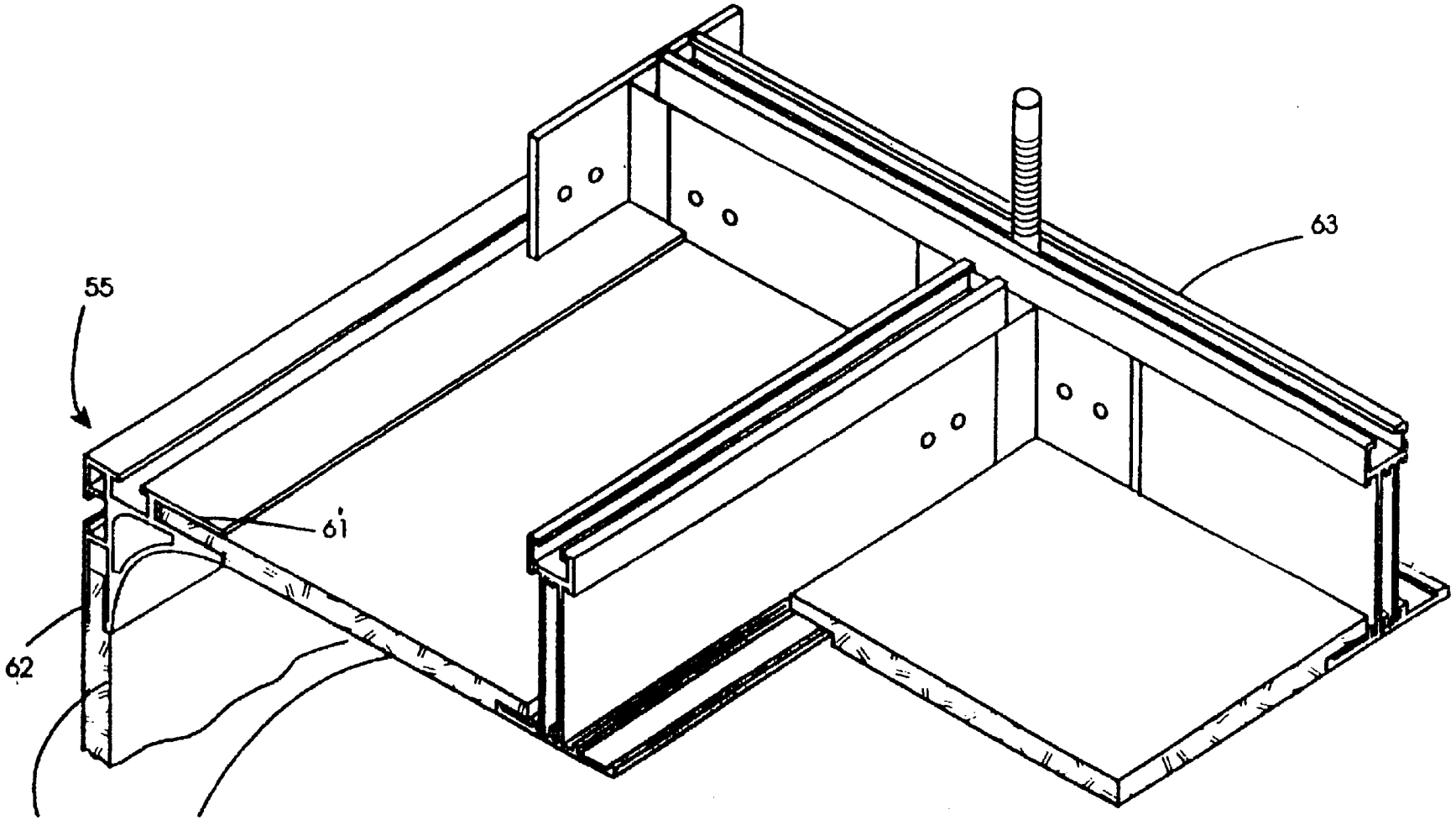
FIG. 8 is a perspective view showing part of a ceiling.

Referring to FIGS. 7 and 8, there is shown a three-way coving member 55 which presents a curved corner surface to the room. The member 55 has a plug member 56 extending in each of the three octagonal directions. The plug members 56 allow connection of the coving member 55 with two-way coving members such as that indicated generally by the numeral 57. The two-way coving member 57 comprises a socket 58 for reception of a plug member 56. It also comprises an upper socket 59 for engagement with a ceiling support fixture and a side socket 60 for engagement with a wall-mounted fixture. The member 57 also comprises a horizontal panel socket 61 and a vertical panel socket 62. As shown in FIG. 8, these sockets receive the side edges of panels 10 to form horizontal and vertical walls. The horizontal panels 10 are also supported by ceiling support members 63 which have ledges for support of the panels 10.

Figure 9:
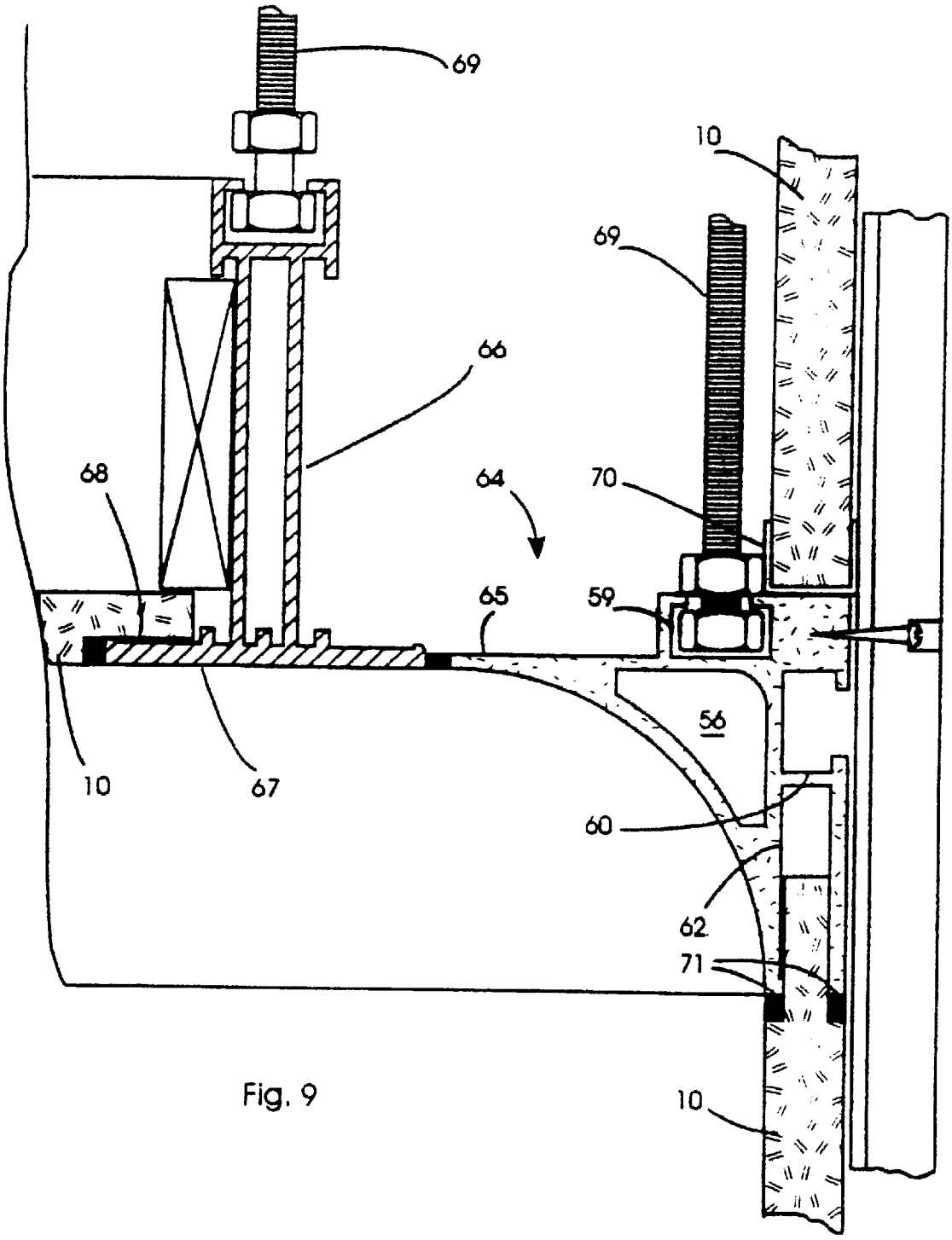
FIG. 9 is a partly cross-sectional view showing suspension of an air wall.

Referring now to FIG. 9, the manner in which a ceiling is supported in another embodiment is shown in detail. In this embodiment, a two-way coving member 64 is used which is much like the coving member 57 and like parts are identified by the same reference numerals. The member 64 has an upper wall 65 which is connected to a ceiling support member 66 by a seal. The ceiling support member 66 has a ledge 67 and a gasket 68 for supporting a panel 10. Again, the joint is completed by a seal having a cross-sectional area in excess of 12 $mm^2$. The socket 59 is connected to a vertically-extending spindle 69 to provide vertical height adjustment during installation. The member 64 includes an upper panel socket 70 for reception of a vertically-extending panel 10. The seals which are used to complete the joints are indicated generally by the numeral 71.

Figure 10:
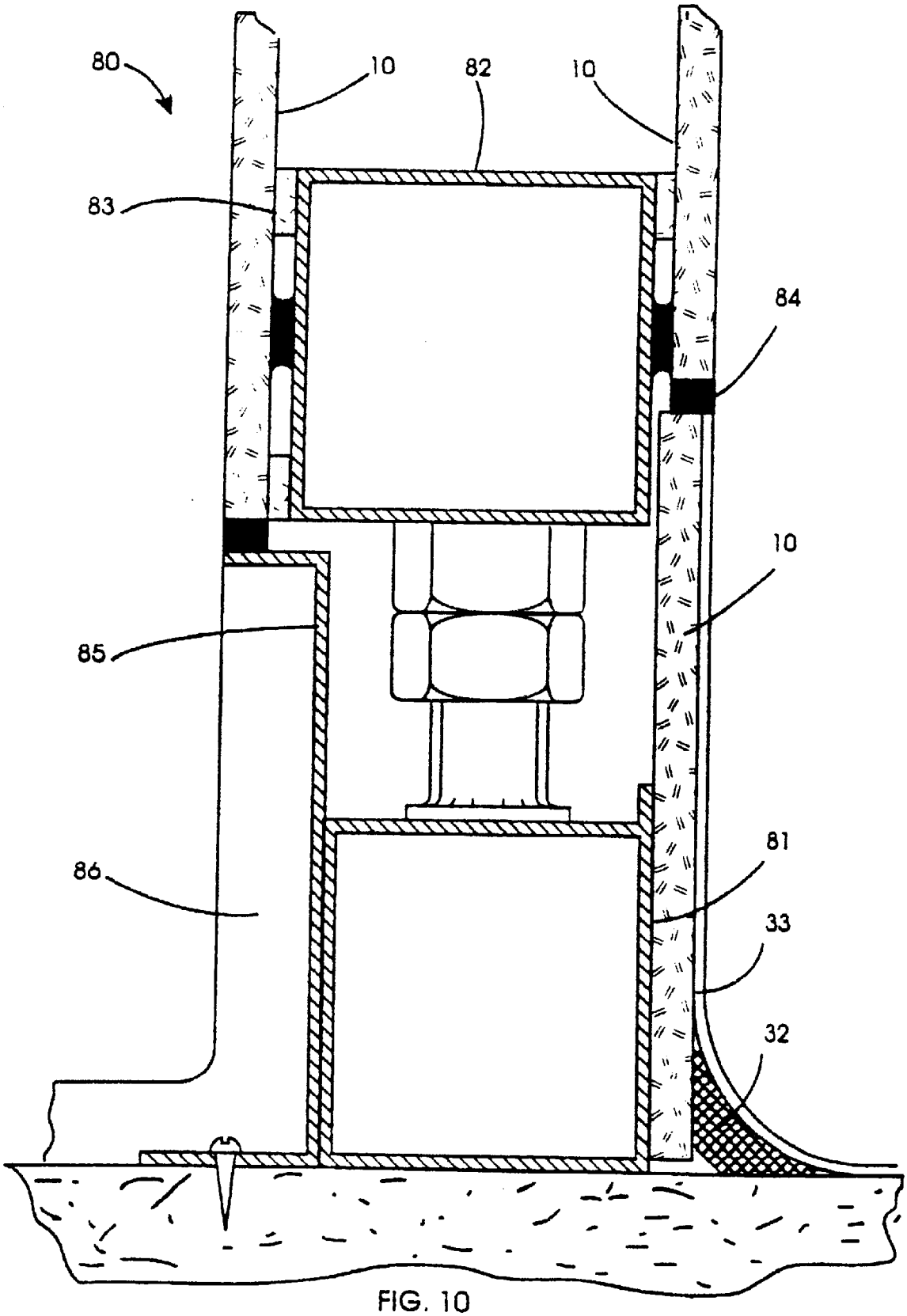
FIG. 10 is a diagrammatic cross-sectional view showing the base of a partition wall.

Referring now to FIG. 10, there is shown a stand-alone partition wall indicated generally by the reference numeral 80. The base of the wall 80 comprises a lower frame 81 secured to an upper frame 82 and these extend along the length of the base of the wall 80. On one side, there is a floor coving member 32 surrounded by a layer 33 as described above. A seal 84 connects the layer 33 to an upper panel 10. On the other side, there is a stainless steel floor trim 85, outside of which there is a floor screed 86. Again, it will be appreciated that by use of the panels 10 and appropriate brackets, there is a large degree of versatility in the manner in which a sterile room structure may be constructed.

It has been found that the combination of use of the panels 10, aluminium parts and sealant provides for both ease of construction and an excellent ability to withstand aggressive cleaning chemicals, to provide the necessary biological seals and anti-static properties. The characteristics of these materials when combined together provide for a long-lasting stable clean room structure in which there is very low particle accumulation. Use of these materials also allows versatility in the construction. The room structure may be easily modified at a later stage by loosening of the bridging members 19 and using the gaps provided, after removal of the seals, in order to remove appropriate panels. It has also been found that the construction of air wall allows outlet of air with an extremely low level of particle accumulation around the lower parts of the room structure.

The invention is not limited to the embodiments hereinbefore described, but may be varied in both construction and detail. For example, the bridging member may be manufactured with a line of weakness to allow them be broken or sliced along their lengths for ease of panel removal. The panels may alternatively be of carbon fibre or of honeycombed aluminium material.

What is claimed is:

1. A sterile room structure comprising:

a wall comprising a plurality of panels having elongate rebates machined in side edges;

panel fasteners comprising bridging members extending between panels at adjoining side edges, each bridging member having tongues inserted in opposed panel rebates and being supported by a soleplate pressing against external non-exposed surfaces of the panels;

coving members presenting external coving surfaces and comprising sockets engaging adjoining wall panels; and seals extending along joints between adjoining panels, between panels and coving members, and between panels and floor covering layers, the seals being of adhesive bio-sealant silicone material, and being shaped to provide a continuous flush exposed surface where panels adjoin.

2. A structure as claimed in claim 1, wherein the panels are of homogenous thermosetting plastics material.

3. A structure as claimed in claim 2, wherein the panels are of polymerised high density phenolic resin material.

4. A structure as claimed in claim 2, wherein the panes are of fused formaldehyde resin composite material.

5. A structure as claimed in claim 1, wherein the coving members are coated on exposed surfaces by a baked enamel polyester coating.

6. A structure as claimed in claim 1, wherein the adhesive seals have a cross-sectional area of at least 12 $mm^2$.

7. A structure as claimed in claim 1, further comprising an air wall supported by a plurality of lateral supports connected at joints between panels.

8. A structure as claimed in claim 7, wherein the lateral supports have an aerofoil configuration.

9. A structure as claimed in claim 7, wherein the lateral supports have an aerofoil configuration and are connected to the air wall by panel fasteners.

10. A structure as claimed in claim 1, wherein the soleplates of the panel fasteners each have an inner recess housing a resilient gasket pressing against the panels.

* * * * *